US005086982A

United States Patent [19]

Hirano et al.

[11] Patent Number: 5,086,982

[45] Date of Patent: Feb. 11, 1992

[54] PULVERIZER

[75] Inventors: Hideo Hirano, Yokosuka; Takuo Kaneko, Joetsu, both of Japan

[73] Assignee: Mitsubishi Kasei Corporation, Tokyo, Japan

[21] Appl. No.: 491,257

[22] Filed: Mar. 9, 1990

[51] Int. Cl.[5] ..... B02C 19/06

[52] U.S. Cl. ..... 241/40; 241/5

[58] Field of Search ..... 241/5, 39, 40, 152 R, 241/80, 97

[56] References Cited

U.S. PATENT DOCUMENTS

| | | | |
|---|---|---|---|
| 251,803 | 1/1882 | Starkey | 241/40 X |
| 1,263,139 | 4/1918 | Stobie | 241/40 |
| 2,119,887 | 6/1938 | Myers . | |
| 3,219,281 | 11/1965 | Jasper et al. . | |
| 3,312,342 | 4/1967 | Brown | 241/40 X |
| 4,930,707 | 1/1990 | Oshiro et al. | 241/5 |

FOREIGN PATENT DOCUMENTS

| | | |
|---|---|---|
| 268154 | 5/1990 | Japan . |
| 268155 | 5/1990 | Japan . |

*Primary Examiner*—Mark Rosenbaum

*Attorney, Agent, or Firm*—Oblon, Spivak, McClelland, Maier & Neustadt

[57] ABSTRACT

A pulverizer capable of effectively eliminating the production of a back pressure during the pulverization of a material on the pulverization surface of a collision member, to thereby accomplish the pulverization with a high efficiency. A collision member arranged in a pulverization chamber opposite to an injection nozzle is formed with a pulverization surface including a central conical surface section formed so as to project from the collision member in the direction opposite to the direction of injection of a jet and have a conical angle of no less than 30 degrees and an annular surface section formed contiguous to the central conical surface section to surround it and perpendicular to the direction of the jet.

10 Claims, 3 Drawing Sheets

PULVERIZER

BACKGROUND OF THE INVENTION

1. Field of the Invention

This invention relates to a pulverizer, and more particularly to a pulverizer for use in subjecting resins, pesticides, cosmetics, pigments, and toners to fine particles of micron order.

2. Description of the Prior Art

There are known several types of pulverizers in the art. In term of pulverizing means used in the pulverizer, the pulverizer is classified as follows:

a) Pulverizer using impact force (e.g. hammer mill, impeller breaker, etc.);

b) Pulverizer using grinding and/or compression force (e.g. roller mill, tower mill, etc.);

c) Pulverizer using crushing force (e.g. jaw crusher, gyrotary crusher, etc.);

d) Pulverizer using impact and grinding forces (e.g. ball mill, rod mill, etc.); and e) Pulverizer using impact and shearing forces (e.g. jet mill, jetmizer, etc.).

When determining a certain type of the pulverizer among these pulverizers for use, thermal characteristics of a material to be pulverized must be considered in addition to the pulverization capacity and efficiency of the pulverizer. For example, pulverization of granular thermoplastic resin, cosmetic, and toner generates heat due to a rapid increase in energy on the surface of the material being pulverized, which results in coagulation and consolidation of fine particles thus prepared. Furthermore, the pulverized fine particles are fused to adhere onto functional parts of the pulverizer for effecting the pulverization. Thus, it is impossible to pulverize the granular thermoplastic resin, cosmetic, and toner by the pulverizer which uses impact, grinding, crushing and compression forces. The preparation of a fine particle of such a material is generally made by the pulverizer using the impact and shearing forces, such as, for example, a jet mill and a jetmizer, because a large amount of compressed cooling gas or low temperature liquid for cooling the particle can be introduced into such a pulverizer.

FIG. 1 shows a conventional pulverizer of the jet mill type, and FIG. 2(*a*) and 2(*b*) show a collision member used in the pulverizer shown in FIG. 1.

The conventional pulverizer shown in FIG. 1 includes a casing 1 in which a pulverization chamber 2 is defined. The casing 1 is formed on one side wall thereof with an injection nozzle 3 for injecting a jet B into the pulverization chamber 2. Also, the casing 1 is formed at the portion of the side wall thereof adjacent to the injection nozzle 3 with a supply port for introducing a material A to be pulverized into the pulverization chamber 2. In the casing 1, a collision member 8 is arranged. The collision member is fixedly mounted on a fixing member 6 to be opposite to the injection nozzle 3 so that the material A, which is supplied to the pulverization chamber 2 while being carried on the jet B, may collide with the collision member 8, for pulverization. Also, the casing 1 is formed therein an annular discharge passage 7. The discharge passage is defined between the inner surface of the casing 1 and the periphery of the collision member 8 and fixing member 6 so as to guide the material A which has been pulverized therethrough to a collector (not shown).

As shown in FIGS. 2(*a*) and 2(*b*), the collision member 8 incorporated in the conventional pulverizer is formed into a disc-like shape and provided with a pulverization surface 8*a* which is flat circular in shape and is arranged so as to be perpendicular to the direction of injection of the jet B. When pulverizing the material A using the collision member 8 shown in FIG. 2(*a*), the whole material A to be pulverized which is introduced through the supply port 4 into the pulverization chamber 2 and carried on the jet B collides directly with the flat circular pulverization surface 8*a* which is positioned in perpendicular to the direction of the jet B.

However, the collision member 8 having the flat circular pulverization surface 8*a* shown in FIG. 2(*a*) causes the material for pulverization to impinge upon the pulverization surface 8*a* at an angle of 90 degrees in relation to the direction of injection of the jet B, which becomes the impact force of the material against the pulverization surface maximum. As a result, a back pressure is produced at the central portion of the pulverization surface 8*a* in proportion to both the velocity of the jet B injected straight into the pulverization chamber 2 and the project section of the flat circular pulverization surface 8*a*, and the impact force of the material A against the pulverization surface 8*a* is significantly decreased at the central portion of the pulverization surface 8*a*. Furthermore, the jet B as well as the material A contained in the jet B turn aside without impinging upon the pulverization surface 8*a* due to interference of the back pressure. Accordingly, the pulverization efficiency of the material, and also the throughput capability of the pulverizer are significantly decreased in the conventional pulverizer shown in FIG. 1.

SUMMARY OF THE INVENTION

The present invention has been made in view of the foregoing disadvantages of the prior art.

Accordingly, it is an object of the present invention to provide a pulverizer which is capable of preventing a back pressure from creating on the circular pulverization surface of a collision member, to thereby accomplish the pulverization of a material with a high efficiency.

In accordance with the present invention, there is provided a pulverizer comprising a pulverization chamber, an injection nozzle provided at the pulverization chamber to inject a jet into the pulverization chamber, a supply port arranged at the pulverization chamber to introduce a material to be pulverized into the pulverization chamber, and a collision member arranged in the pulverization chamber opposite to the injection nozzle. The collision member is provided with a pulverization surface with which the material to be pulverized directly collides while being carried on the jet. In an embodiment of the present invention, the pulverization surface of the collision member includes a central conical surface projecting from the collision member in the direction opposite to the direction of injection of the jet, the conical angle of which is no less than 30 degrees, and an annular surface which is contiguous to the central conical surface.

BRIEF DESCRIPTION OF THE DRAWINGS

These and other objects and many of the attendant advantages of the present invention will be readily appreciated at the same becomes better understood by reference to the following detailed description when considered in connection with the accompanying drawings in which like reference numerals designate like or corresponding parts throughout; wherein:

FIG. 2(*b*) is a front elevation view of the collision member shown in FIG. 2(*a*);

FIG. 4(*b*) is a front elevation view of the collision member shown in FIG. 4(*a*);

DETAILED DESCRIPTION OF THE PREFERRED EMBODIMENT

Now, a pulverizer according to the present invention will be described in detail with reference to FIGS. 3 to 7.

Figure 1:
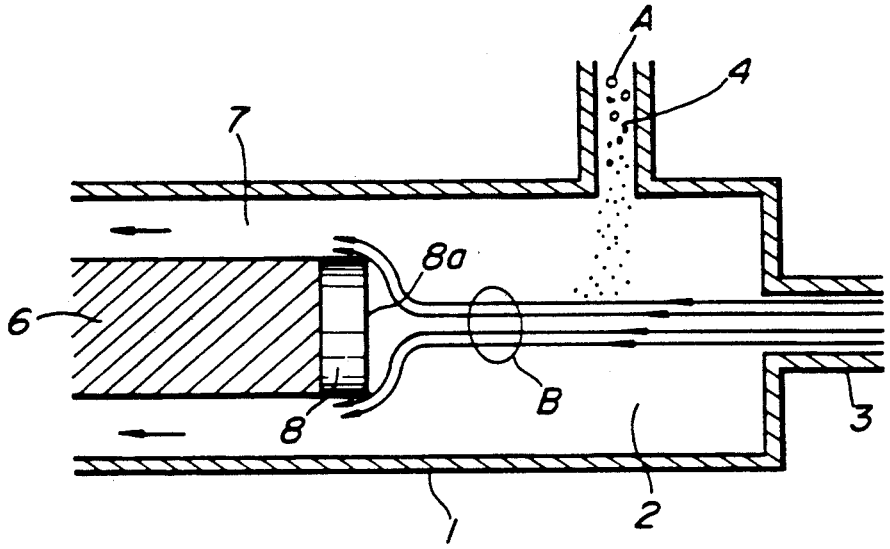
FIG. 1 (PRIOR ART)
FIG. 1 is a sectional view schematically showing a conventional pulverizer of the jet mill type.
Figure 2A:
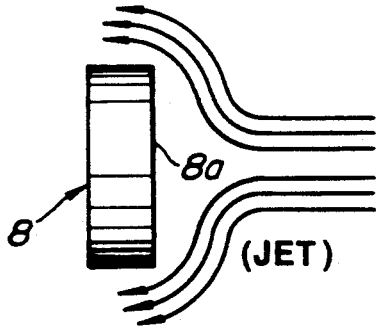
FIG. 2(a) (PRIOR ART)
FIG. 2(*a*) is a side elevation view showing a collision member incorporated in the conventional pulverizer shown in FIG. 1.
Figure 2B:
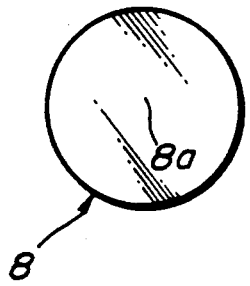
FIG. 2(b) (PRIOR ART)
Figure 3:
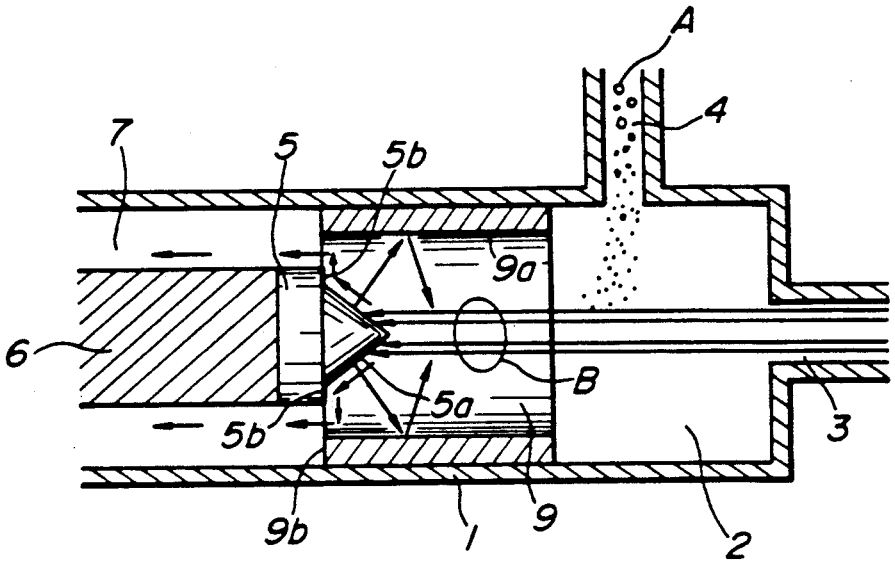
FIG. 3 is a sectional view schematically showing a pulverizer of the jet mill type according to an embodiment of the present invention.
Figure 4A:
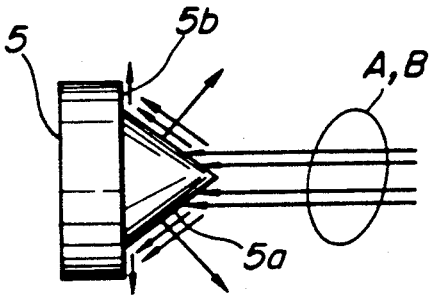
FIG. 4(*a*) is a side elevation view showing a collision member incorporated in the pulverizer shown in FIG. 3.
Figure 4B:
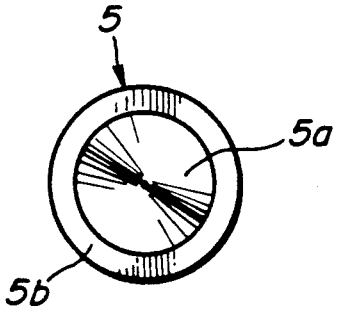

FIG. 3 schematically illustrates the general structure of a pulverizer of the jet mill type according to an embodiment of the present invention, and FIGS. 4(*a*) and 4(*b*) show a collision member incorporated in the pulverizer shown in FIG. 3.

The pulverizer shown in FIG. 3 includes a casing 1 in which a pulverization chamber 2 is formed. The casing 1 is provided with an injection nozzle 3 for generating a jet B in the pulverization chamber 2 and a supply port 4 for supplying a material A to be pulverized to the pulverization chamber 2. The material to be pulverized according to the present invention is selected from the group consisting of resins, pesticides, pigments, toners and the like which requires the pulverization of micron order. In the casing 1, a collision member 5 is arranged. The collision member is fixedly mounted on a fixing member 6 to be opposite to the injection nozzle 3 so that the material A, which is supplied to the pulverization chamber 2 while being carried on the jet B, may collide with the collision member 5 for subjecting it to the pulverization. The casing 1 further is provided with an annular discharge passage 7 and a cylindrical collision ring 9 which is lined with the inner surface of the casing 1. The discharge passage 7 is defined between the inner surface of the casing 1 and the periphery of the collision member 5 and fixing member 6 so as to guide the material A which has been pulverized by the collision with the collision member 5 therethrough to a collector (not shown).

The collision member 5 incorporated in the pulverizer, as shown in FIGS. 4(*a*) and 4(*b*), is provided with a pulverization surface which includes a central conical surface 5*a* projecting from the collision member 5 in the direction opposite to the direction of injection of the jet B, the conical angle of which is no less than 30 degrees, and an annular surface 5*b* which is contiguous to the central conical surface 5*a* surrounding the central conical surface 5*a*. In the embodiment shown in FIG. 3, the annular surface 5*b* is formed perpendicular to the direction of injection of the jet B.

The cylindrical collision ring 9 includes an inner peripheral surface 9*a*, the diameter of which is larger than that of the collision member 5, and is arranged along the path of the jet B in the casing in concentric relationship with the collision member 5 extending from substantially the same plane as the annular surface 5*b* of the collision member 5 lies.

In operation, the material A to be pulverized is introduced through the supply port 4 into the pulverization chamber 2 and carried on the jet B injected from the injection nozzle 3. The jet B containing the material A to be pulverized impinges upon the collision member 5 rectified by the inner peripheral surface 9*a* of the cylindrical collision ring 9 without being influenced by any turbulent flow of the jet B which is liable to be created around the injection nozzle 3. The material A carried on the jet B first impinges upon the distal end of the central conical surface 5*a* of the collision member 5 and travels close to the conical wall contour due to a Coanda effect. Then, the whole material A stikes against the annular surface 5*b* which is contiguous to the conical surface 5*a* of the collision member 5 and is perpendicular to the jet's axis so that it may be pulverized in a fine particle. According to the present invention, a back pressure is not created at the central portion of the pulverization surface of the collision member due to the existence of the central conical surface 5*a* projecting from the central portion of the collision member 5 and also the laminar flow of the material A travelling along the periphery of the conical surface 5*a* of the collision member. Accordingly, the impact force of the material A against the pulverization surfaces 5*a* and 5*b* is not reduced, nor does the material A turn aside and direct to the discharge passage 7 without impinging upon the pulverization surfaces 5*a* and 5*b* of the collision member 5. Thus, the fine particles of the material A can be produced with a high efficiency in accordance with the present invention.

The material A having the initial particle size not being pulverized by the impingement with the conical and annular surfaces 5*a* and 5*b* of the collision member 5, or relatively larger particles contained in the material A is repelled by the conical surface 5*a* and disperses in the casing 1. The dispersed particles are then impinged upon the inner peripheral surface 9*a* of the cylindrical collision ring 9 for subjecting these particles to the secondary pulverization, or involved in the jet B again without impinging with the cylindrical collision ring to undergo the pulverization. In this manner, the effective pulverization of the material A can be achieved.

Figure 5:
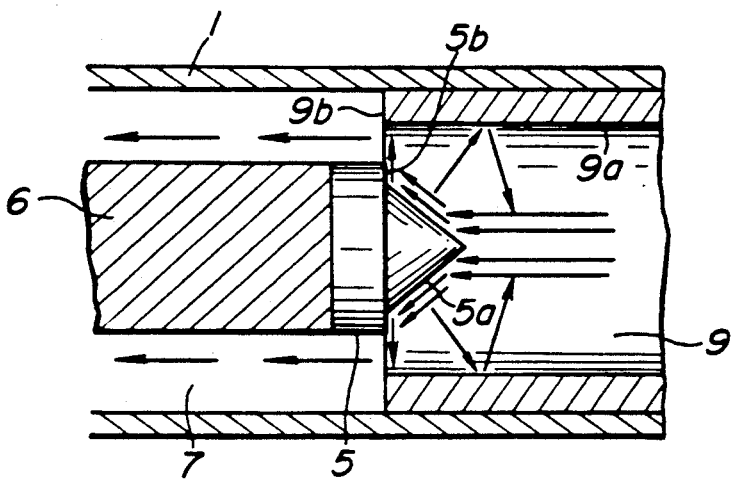
FIG. 5 is a partially enlarged sectional view of the pulverizer shown in FIG. 3.

The cylindrical collision ring 9 having an open end surface 9*b* coincide with the annular surface 5*b* of the collision member 5 shown in FIG. 5 makes the particles repelled by the conical and annular surfaces 5*a* and 5*b* of the collision member 5 to impinge effectively with the inner peripheral surface 9*a* of the cylindrical collision ring 9 so that the secondary pulverization or repellant of the material A by the inner peripheral surface 9*a* may be promoted. In other words, the cylindrical collision ring 9 makes it possible to capture the scattered particles in the casing 1 satisfactorily by having the particles after having been impinged with the inner peripheral surface 9*a* involved in the jet B again to undergo the pulverizing operation. The cylindrical collision ring for rectify the jet B includes a uniform sectional area for effecting the pulverization of the material A and the rectification of the jet B around the entire periphery of the collision member 5, which permits the particles repelled by the collision member to be pulverized again on the inner peripheral surface 9*a* of the cylindrical ring 9. The uniform pulverization of the material A and the rectification of the jet B can be acheived if the cylindrical collision ring is used together with the collision member as shown in FIG. 4. The cylindrical collision ring 9 is not necessarily required if the inner peripheral surface of the pulverization chamber is uniform along the entire periphery of the collision member 5. However, the inner surface of the pulverization chamber is not always cylindrical in shape, and also the discharge passage is provided on a wall of the casing in the lateral direction of the collision member in some pulverizers. The cylindrical collision ring is particularly useful to be provided in such a pulverizer.

Figure 6:
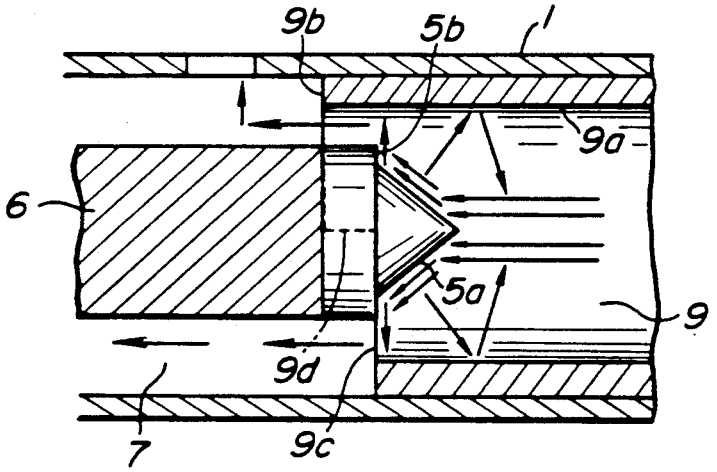
FIG. 6 is a partially enlarged sectional view of a pulverizer according to another embodiment of the present invention.

FIG. 6 shows another embodiment of a cylindrical collision ring according to the present invention. The cylindrical collision ring 9 shown in FIG. 6 is divided into halves to have a semicircular upper open end surface 9*b* and a semicircular lower open end surface 9*c*. In the embodiment shown in FIG. 6, the cylindrical collision ring 9 is arranged in the casing 1 to have the semicircular upper end surface 9*b* projected beyond the annular surface 5*a* of the collision member 5 to the discharge passage 7, and the material A after having been pulverized is collected through a conduit (not shown) which is open to the discharge passage 7 communicating with the semicircular upper half 9*d* of the cylindrical collision ring 9. The semicircular upper open end surface 9*b* projected beyond the annular surface 5*a* of the collision member 5 is effective to maintain a balance between the injection pressure and the discharge pressure of the jet B in the vicinity of the outer periphery of the annular surface 5*b* of the collision member 5, which enables to pulverize the material A uniformly impinging upon the pulverization surfaces 5*a* and 5*b* of the collision member 5. The arrangement of the collision ring shown in FIG. 6 effectively prevents the pressure of the jet B from decreasing in the upper discharge passage to which the collector is connected, which results in jet B imbalance between the upper and lower discharge passages.

As a result of inventor's experiments on the conical angle of the central conical pulverization surface 5*a*, it was found that it may be set preferably at no less than 30 degrees, more preferably within the range of from 40 degrees to 120 degrees and most preferably within the range of from 60 degrees to 100 degrees. Also, in the embodiments shown in FIGS. 3 to 6, the annular pulverization surface 5*b* is formed so as to be contiguous to the central conical pulverization surface 5*a* and to be perpendicular to the direction of injection of the jet B. However, the arrangement of the annular surface 5*b* is not limited to such a particular angle. The angle of the surface 5*b* may be set at a desired value so long as it prevents the generation of a back pressure due to the collision of the material travelling along the conical surface 5*a* and the annular surface 5*b*. In general, the annular surface 5*b* may be formed contiguous to the conical surface section 5*a* in such a manner that it is outwardly open at preferably an angle of no less than 5 degrees with respect to an extension line of the conical surface 5*a*, more preferably no less than 10 degrees. The angle of this range effectively prevents the generation of the back pressure.

Figure 7:
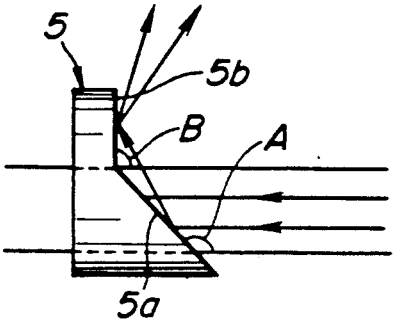
FIG. 7 is a side elevation view showing a collision member incorporated in the pulverizer according to another embodiment of the present invention.

FIG. 7 is another embodiment of a collision member to be incorporated in the pulverizer according to the present invention. The collision member 5 shown in FIG. 7 includes a principal collision surface 5*a* having an inclination angle A of no less than 100 degrees with respect to the direction of the injection of the jet B on which the jet B directly impinges, and a supplemental collision surface 5*b* which is contiguous to the principal collision surface 5*a* having an inclination angle of no less than 90 degrees with respect to the direction of injection of the jet B and no more than the inclination angle A of the principal collision surface 5*a*. The relationship of the each inclination angle of the principal and the supplemental collision surfaces with respect to the direction of the injection of the jet B is defined as follows:

$$A \geqq 100^\circ,\ A \geqq B \geqq 90^\circ$$

The practical angles A and B of the inclination are decided in accordance with a kind of the material to be pulverized and the pulverization degree of the material. In general, the angle A is preferably set within the range of 110° to 160°, more preferably within the range of 120° to 150°. The angle B is set within the range of 5° to 20° smaller than the angle A, more preferably 10° smaller than the angle A.

The invention will be more readily understood with reference to the following example.

EXAMPLE

The material A to be pulverized was prepared from the following components.

| | |
|---|---|
| Styrene-methacrylate resin | 100 parts by weight |
| Carbon black | 5 parts by weight |
| Dye | 5 parts by weight |

The above components were fully kneaded by twin-screw extruder, and then it was cooled. Thereafter, the mixture was charged in a feather mill for the purpose of grinding it to obtain the material A of no more than 3 mm in particle diameter.

The pulverizer as described in FIG. 3 having the collision member 5 which has dimensions of 50 mm in diameter of the project section, 40 mm in diameter of bottom of the conical surface 5*a* and 60 degrees in conical angle of the conical surface was used in the experiment. Also, the pulverizer having the collision member 5 which has dimensions of 50 mm in diameter of the project section, 40 mm in diameter of bottom of the conical surface 5*a* and 60 degrees in conical angle of the conical surface was used. Compressed air was supplied at a flow rate of 10 $m^3$/min at 5.5 kg/$cm^2$G. For comparison, the conventional pulverizer which includes the collision member 8 having a diameter of 90 mm and a project section of 50 mm in diameter was used. The material A was pulverized using the apparatus of the present invention and the conventional apparatus. The results were as shown in Table 1.

TABLE 1

| Pulverizer | Prior Art | | Present Invention | |
|---|---|---|---|---|
| Project Section (dia) | 50 mm | 90 mm | 50 mm | 90 mm |
| Throughput | 20 kg/H | 38 kg/H | 24 kg/H | 49 kg/H |
| Particle Size Distribution | | | | |
| Average Diameter | 10.2μ | 10.3μ | 10.3μ | 10.3μ |
| 20μ or more | 1.0 wt % | 1.1 wt % | 0.8 wt % | 0.8 wt % |
| 5μ or less | 11.6 wt % | 11.8 wt % | 11.7 wt % | 11.6 wt % |

The particle size distribution was measured using a coulter counter of 100μ in aperture size ("TA-II" manufactured by Nikkaki).

As is apparent from Table 1, the pulverizer of the present invention increases in pulverization performance by about 20% in case where the project section is 50 mm in diameter and about 30% in case where the project section is 90 mm in diameter as compared with the conventional pulverizer.

As can be seen from the foregoing, the pulverizing apparatus of the present invention is so constructed that the pulverization surface of the collision member arranged in the pulverization chamber opposite to the injection nozzle comprises the central conical surface section projecting from the collision member in a direction opposite to the direction of injection of the jet and having a conical angle of no less than 30 degrees and the annular surface formed contiguous to the central conical surface section. Thus, the pulverizer according to the present invention permits the material to be pulverized which introduced into the pulverization chamber through the supply port to reach the distal end of the conical pulverization surface formed at the central portion of the collision member while being carried on the jet injected from the injection nozzle into the pulverization chamber, and then to be guided to the bottom of the conical surface along the periphery of the conical surface due to a Coanda effect. Then, all the material directly collides with the annular pulverization surface formed contiguous to the conical surface. Thus, the present invention effectively prevents the generation of a back pressure which turns aside the material toward the discharge passage without colliding with the pulverization surface, to thereby accomplish the pulverization with high efficiency and increase the productivity, thereby improving the throughput of the pulverizer.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A pulverizer having a decreased back pressure comprising:

a pulverization chamber;

an injection nozzle provided at said pulverization chamber to inject a jet traveling in a first direction through said pulverization chamber;

a supply port arranged at said pulverization chamber to introduce a material to be pulverized into said pulverization chamber;

a collision member arranged in said pulverization chamber opposite to said injection nozzle having a pulverization surface on which said material to be pulverized impinges together with said jet;

said pulverization surface of said collision member including a first collision surface inclined with respect to the direction of injection of said jet and a second collision surface contiguous to said first collision surface, whereby said material is subjected to impinge upon said first collision surface together with said jet for traveling close to said first collision surface contour and strike against said second collision surface for pulverization;

a passage means downstream of said first and second collision surfaces for permitting said jet to continue in substantially said first direction; and a cylindrical collision ring lined with an inner peripheral surface of said pulverization chamber, said cylindrical collision ring being larger in diameter than said collision member and arranged along a path of said jet in said pulverization chamber in concentric relationship with said collision member, said passage means including a discharge passage passing between said cylindrical collision ring and said collision member;

whereby back pressure of the jet upstream of said pulverization surface is reduced.

2. The pulverizer as defined in claim 1, wherein said cylindrical collision ring extends from substantially the same plane as said second collision surface of said collision member.

3. The pulverizer as defined in claim 1, wherein said cylindrical collision ring extends beyond said second collision surface of said collision member in the direction of a discharge passage of said material in said pulverization chamber.

4. The pulverizer as defined in claim 3, wherein said cylindrical collision ring is divided into halves to have a semicircular upper open end surface and a semicircular lower open end surface, said semicircular upper open end surface extends beyond said second collision surface of said collision member in the direction of said discharge passage of said material in said pulverization chamber and said semicircular lower open end surface lies in substantially the same plane as said second collision surface of said collision member.

5. The pulverizer as defined in claim 1, wherein said first collision surface is conical shape projected from said collision member in the direction opposite to the direction of injection of said jet and said second collision surface is an annular rim formed around the base of said first conical collision surface.

6. The pulverizer as defined in claim 5, wherein said conical first collision surface has a conical angle of no less than 30 degrees.

7. The pulverizer as defined in claim 6, wherein said conical angle of said first collision surface is within a range of 60 degrees to 100 degrees.

8. The pulverizer as defined in claim 5, wherein said second collision surface extends radially from the base of said first conical collision surface so as to be perpendicular to the direction of injection of said jet.

9. The pulverizer as defined in claim 1, wherein said first collision surface has an inclination angle of no less than 100 degrees with respect to the direction of injection of said jet and said second collision surface has an inclination angle of no less than 90 degrees with respect to the direction of injection of said jet and no more than said inclination angle of said first collision surface.

10. The pulverizer as defined in claim 9, wherein said inclination angle of said first collision surface is within a range of 100 degrees to 160 degrees and said inclination angle of said second collision surface is within a range of 5 degrees to 20 degrees smaller than said inclination angle of said first collision surface.

* * * * *